US005518326A

United States Patent [19]

Yoshino et al.

[11] Patent Number: 5,518,326

[45] Date of Patent: May 21, 1996

[54] IMPACT PRINTER WHICH CAN DETECT PARTIAL DEFECTS IN COILS

[75] Inventors: Satoshi Yoshino; Akihiro Abe, both of Kawasaki, Japan

[73] Assignee: Fujitsu Limited, Kanagawa, Japan

[21] Appl. No.: 355,801

[22] Filed: Dec. 14, 1994

Related U.S. Application Data

[63] Continuation of Ser. No. 89,652, Jul. 9, 1993, abandoned.

[30] Foreign Application Priority Data

Jul. 31, 1992 [JP] Japan ..... 4-204901

[51] Int. Cl.[6] ..... B41J 9/52

[52] U.S. Cl. ..... 400/74; 400/157.2

[58] Field of Search ..... 400/54, 74, 157.2, 400/157.3, 166, 167

[56] References Cited

U.S. PATENT DOCUMENTS

| | | | |
|---|---|---|---|
| 4,706,561 | 11/1987 | Greer | 400/157.2 |
| 4,819,556 | 4/1989 | Abe et al. | 400/121 |

FOREIGN PATENT DOCUMENTS

| | | | |
|---|---|---|---|
| 51-78932 | 7/1976 | Japan | 400/121 |
| 52-85422 | 7/1977 | Japan | 400/121 |
| 52-85421 | 7/1977 | Japan | 400/121 |
| 54-84026 | 6/1979 | Japan | 400/157.2 |
| 57-108974 | 7/1982 | Japan | 400/157.2 |
| 37566 | 2/1992 | Japan | 400/55 |

*Primary Examiner*—Edgar S. Burr
*Assistant Examiner*—Steven S. Kelley

[57] ABSTRACT

An impact printer which can detect halfway defects of printing coils such as partial short circuits is disclosed. The impact printer according to the present invention includes at least one printing coil for driving a printing element and driving transistor which controls the printing element by switching a current flowed through the printing coil, and further includes an inductance detection means for detecting whether or not said printing coil has an appropriate inductance.

8 Claims, 11 Drawing Sheets

IMPACT PRINTER WHICH CAN DETECT PARTIAL DEFECTS IN COILS

This is a continuation of application Ser. No. 08/089,652, filed Jul. 9, 1993, now abandoned.

BACKGROUND OF THE INVENTION (1) Field of the Invention

The present invention relates to an impact printer.

Impact printers are divided roughly into two types, one type uses a hammer and strikes printing type to print letters and characters, and the other type is a wire-dot printer which has a plurality of wire-dot pins which print characters composed of image dots printed by the wire-dot pins. Every impact printer includes at least one coil to drive the printing hammer or the wire-dot pins. In this specification, the coil used to drive the printing hammer or the wire-dot pins is called a printing coil. A drive transistor is provided for each printing coil to control a current flow through the coil. A character or a dot is printed when the current flows through the coil.

(2) Description of the Related Art

In an impact printer, when the coil or the transistor become defective due to either an open circuit or a short circuit, a printing operation cannot be carried out. Further, when the current through a short circuit in the transistor continues to flow, the coil driven by the transistor may be damaged by overheating. In order to avoid these problems, a prior art impact printer includes a detection circuit to detect an open circuit or a short circuit in the printing coil or the driving transistor.

For example, Japanese Unexamined Patent Publication (Kokai) No. 51-78932 discloses a detection method for detecting whether or not a hammer driven by a magnetic circuit is operating properly in response to a drive signal. Japanese Unexamined Patent Publication (Kokai) No. 52-85421 discloses a detection apparatus for selectively detecting erroneous operation of a plurality of switching circuits for printing hammer magnets. Japanese Unexamined Patent Publication (Kokai) No. 52-85422 discloses a detection method for detecting erroneous operation of printing hammer magnets. Japanese Unexamined Utility Model Publication (Kokai) No. 54-84026 discloses a pulse motor which includes a detection means for detecting erroneous operation of a switching circuit for a coil. Japanese Unexamined Patent Publication (Kokai) No. 57-108974 discloses a printing apparatus in which short circuits in a plurality of printing magnet coils are selectively detected. Further, U.S. Pat. No. 4,819,556 discloses a fundamental constitution of a line printer having a shuttle on which a plurality of printing elements are arranged.

According to these documents, the reliability of an impact printer is improved. However, the above documents disclose impact printers in which only open circuits and short circuits in a printing coil or a driving transistor can be detected. Namely, these impact printers can detect defects only when printing coils or drive transistors are completely open or short-circuited. However, in practice, defects other than open circuits or short circuits of the printing coils or drive transistors can occur. For example, when a printing coil is partially short-circuited or the distance between a printing coil and the iron core of a magnetic circuit is changed, the driving ability of the printing element decreases. This defect can cause a reduction in print density. In the prior art impact printer, this defect cannot be detected because the printing coil is not completely open or short-circuited.

SUMMARY OF THE INVENTION

An object of the present invention is to realize an impact printer capable of detecting partial defects of printing coils which are not completely open or short-circuited.

According to the present invention, an impact printer comprises at least one printing coil for driving a printing element, switching means which controls the printing element by switching a current flowing through the printing coil, and an inductance detection means for detecting whether or not the printing coil has an appropriate inductance.

When a defect in a printing coil which is not completely open or short-circuited occurs, the inductance of the printing coil changes. Therefore, the impact printer can detect such a defect by using the inductance detection means.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

The present invention can be applied to all types of impact printers. In the following, embodiments of a line printer to which the present invention is applied are described. Before describing the preferred embodiments of the present invention, the general structure and operation of a line printer which has a plurality of printing elements, and the operation of a prior art line printer, are described with reference to FIGS. 1, 2 and 3.

Figure 1:
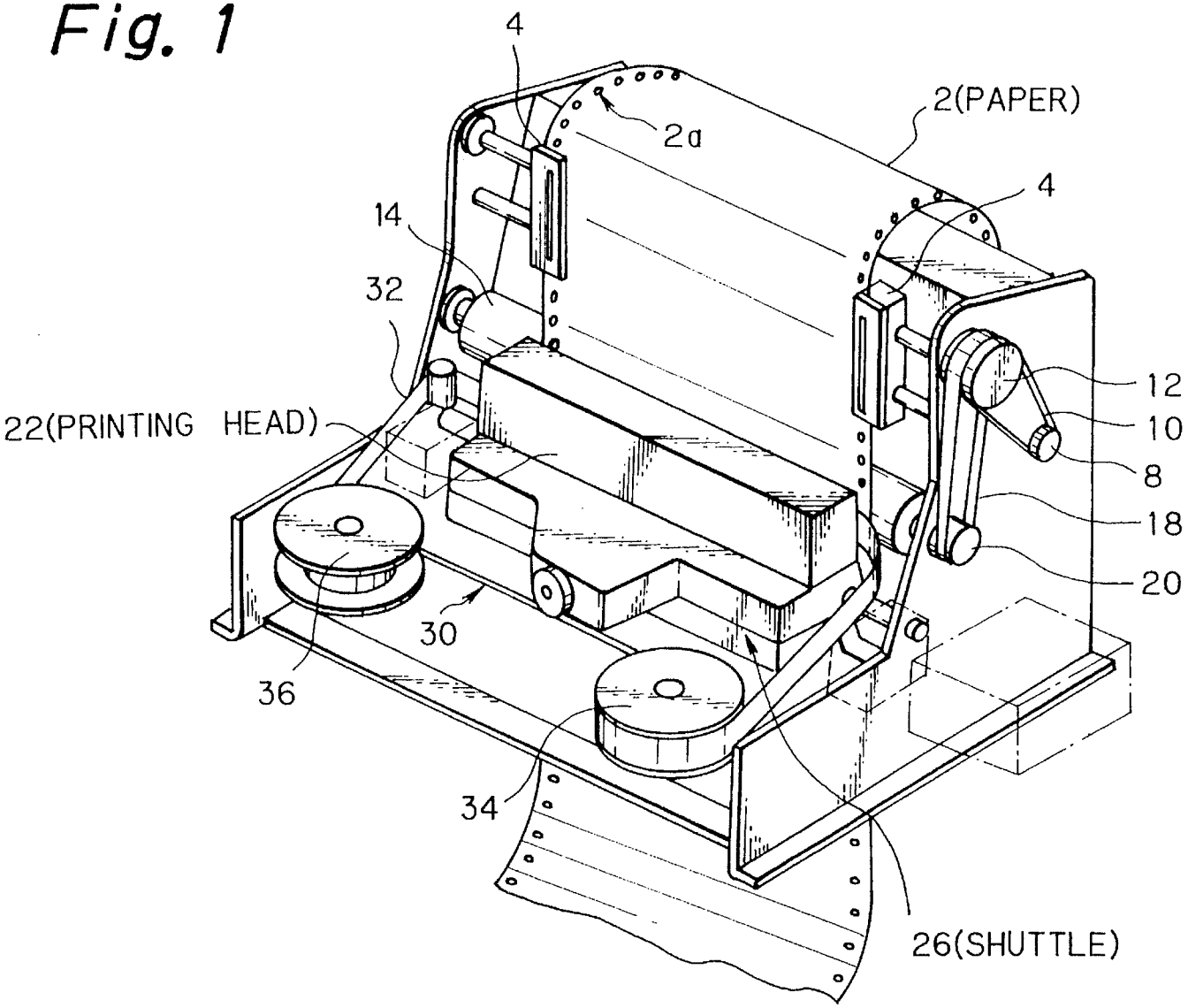
FIG. 1 is a perspective view of a line printer to which the present invention is applied.

FIG. 1 is an overall perspective view of a line printer. The line printer includes a paper feed mechanism which feeds continuous (pin-feed) paper 2, a platen 14, a printing head 22 arranged on a shuttle 26, a shuttle moving mechanism and an ink ribbon feed mechanism. The paper feed mechanism feeds the paper 2 by rotating a tractor 4 which includes tractor-pins coupled with feed-holes 2*a* of the paper 2. The tractor 4 is driven by a paper feed motor via a first gear 8, a timing belt 10 and a second gear 12. The platen 14 is arranged opposite to the printing head 22 and guides the paper 2 by rotation. The platen 14 is rotated by the paper feed mechanism via a timing belt 18 and a gear 20.

The printing head 22 is composed of a plurality of printing blocks (e.g., 12 blocks) each of which has a plurality of wire-dot pins (e.g,. 24 pins), and the printing head 22 is arranged on the shuttle which is moved in a horizontal direction along a guide 30 by the shuttle moving mechanism. A total of 288 wire-dot pins are arranged on the shuttle 26. The shuttle moving mechanism includes a shuttle driving motor which is composed of a plurality of shuttle moving magnets and a plurality of shuttle moving coils. These shuttle moving magnets are arranged on the under side of the shuttle 26 and these shuttle moving coils are arranged on a frame of the impact printer. The shuttle 26 is moved in both horizontal directions by this shuttle moving mechanism.

In the impact printer shown in FIG. 1, the paper 2 to be printed is fed by the platen 14 and the tractor 4. Printing is carried out by the printing head 22 through the ink ribbon 5. The printing blocks comprising the printing head 22 are arranged at predetermined intervals, therefore, the length of travel of each printing block, namely, the distance of the shuttle can be moved can be much narrower than the total printing width.

Figure 2:
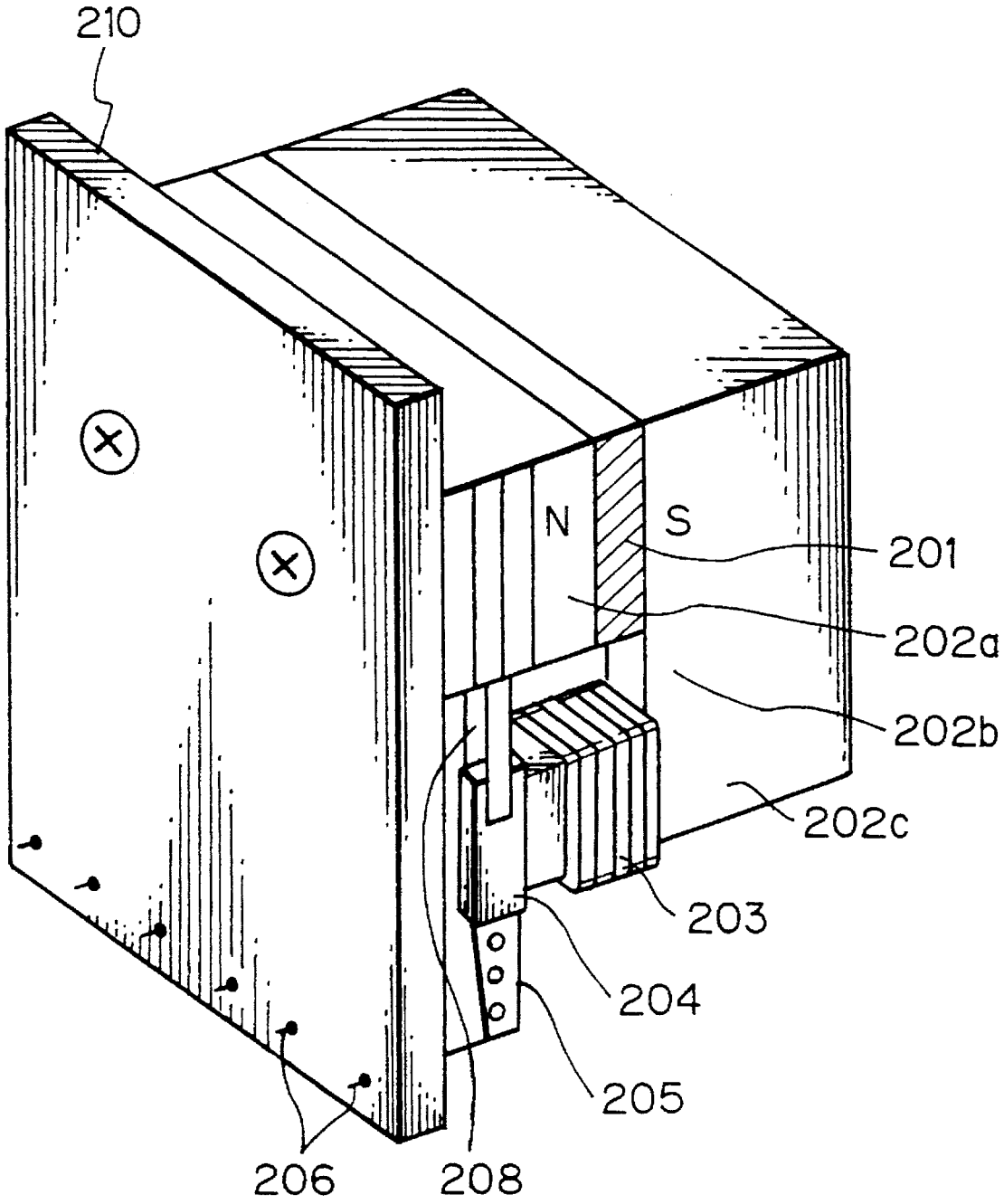
FIG. 2 is a perspective view of each printing element block of the line printer of FIG. 1.
Figure 3:
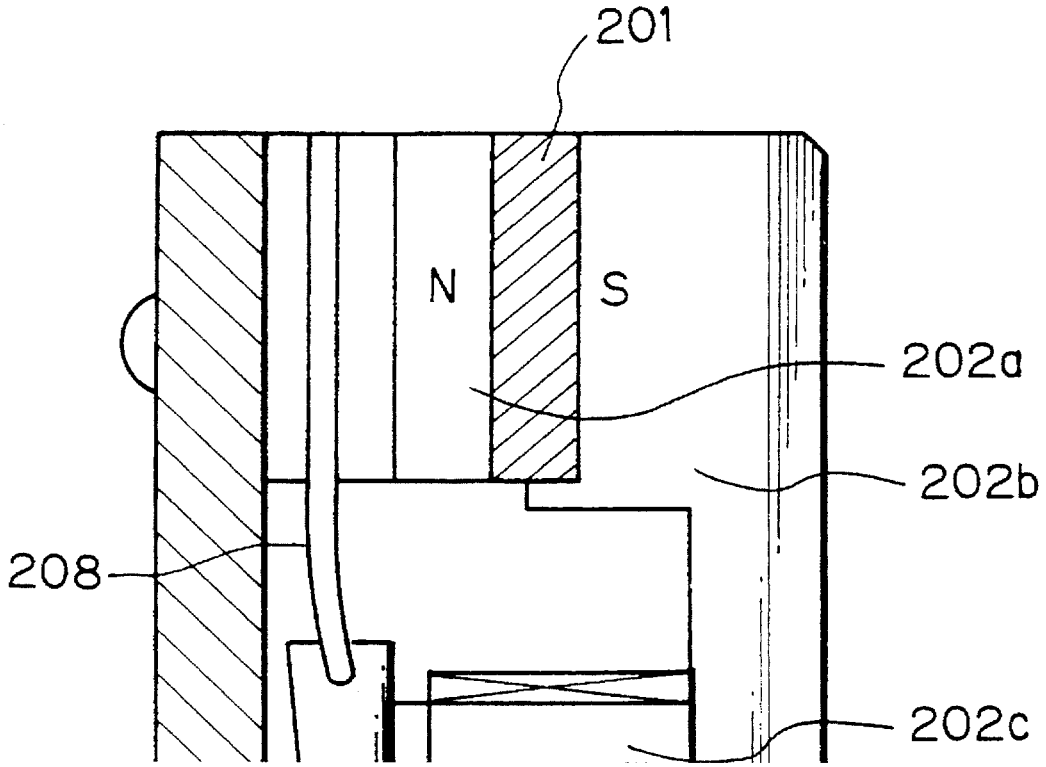
FIG. 3 is a side crosssection of each printing element block of the line printer of FIG. 1.

FIGS. 2 and 3 are diagrams showing the constitution of one of the printing element blocks which compose the printing head. FIG. 2 is a perspective view of the printing element block, and FIG. 3 is a side cross-sectional view of the printing element block.

In FIGS. 2 and 3, reference numeral 201 designates a permanent magnet which is composed of layers laminated between yokes 202*a* and 202*b*. An iron core 202*c* is composed of layers laminated on the yoke 202*b*, and an electromagnetic coil 203 which corresponds to a printing coil is wound on the iron core 202*c*. An armature 204 supported with a plate spring 208 is arranged at a portion opposite to the iron core 202*c*. The armature 204 is held so as to be drawn to the iron core 202*c* by a magnetic drawing force of the permanent magnet 201. A beam 205 having a printing wire-dot pin 206 at the top is brazed to the top of the armature 204. Six electromagnetic driving portions each having this constitution are arranged in parallel on a plate 210 and form the element block. Therefore, the element block havs six wire-dot pins. Further, the printing block is composed of four element blocks arranged 2 by 2 in both directions, namely, the printing block has 24 wire-dot pins. Twelve printing blocks are arranged on the shuttle 26.

Next, a first embodiment of the present invention is explained. In the first embodiment, an inductance detection circuit is arranged at each electromagnetic driving portion corresponding to each wire-dot pin. A circuit diagram of each electromagnetic driving portion of an impact printer according to the first embodiment is shown in FIG. 4.

Figure 4:
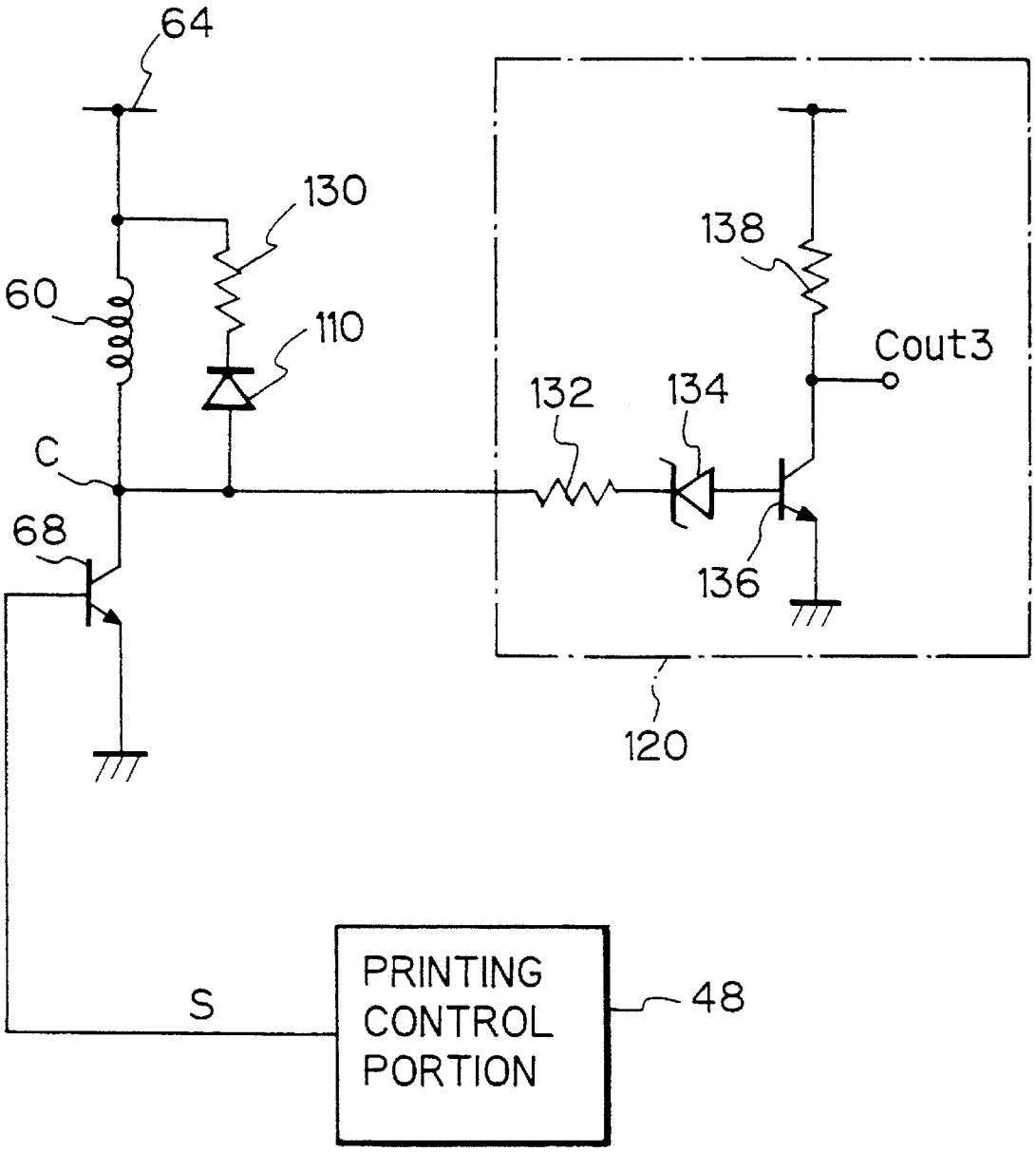
FIG. 4 is a circuit diagram of an inductance detection circuit of a first embodiment.

As shown in FIG. 4, this circuit includes a printing coil 60, a drive transistor 68, diode 110, a resistor 130, a printing control portion 48, and a back electromotive force detection circuit 120 for detecting a voltage fluctuation due to a back electromotive force of the printing coil 60.

The printing coil 60 corresponds to a coil 203 of FIGS. 2 and 3, and the drive transistor 68 switches a current flowing through the coil 60. The printing coil 60 and the drive transistor 68 are serially connected between a voltage source 64 and ground, and a printing control signal S from the printing control portion 48 is input to the base of the drive transistor 68. When the control signal S is a high level, the drive transistor 68 is continuously on and an electromagnetic force is generated by a current flowing from the voltage source 64 to the ground via the printing coil 60 and the drive transistor 68. As shown in FIG. 4, a connection node of the printing coil 60 and the driving transistor 68 is designated by C.

A diode 110 and a resistor 130 are serially connected together, and the other ends of the diode 110 and the resistor 130 are connected to the opposite ends of the printing coil 60, with the anode of the diode 110 connected to the node C and the cathode connected through the resistor 130 to the voltage source 64. The coil 60, the diode 110 and the resistor 130 form a closed loop.

As shown in FIG. 4, the back electromotive force detection circuit 120 includes a resistor 132, a zener diode 134, a transistor 136 and a resistor 138. The resistor 138 and the transistor 136 are serially connected between the voltage source and the ground, and the base of the transistor 136 is connected to the node C via the resistor 132 and the zener diode 134.

An output signal Cout3 of the back electromotive force detection circuit 120 is obtained from the collector of the transistor 136.

Figure 5A:
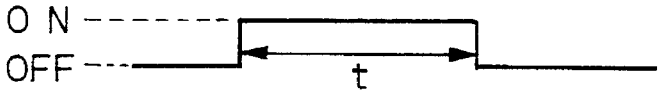
FIGS. 5A to 5D are diagrams showing waveforms of the circuit of FIG. 4.
Figure 5B:
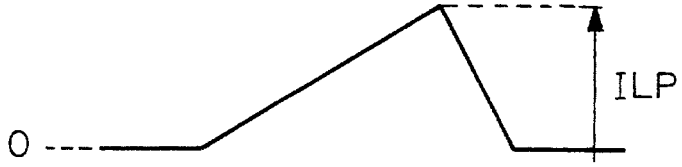
Figure 5C:
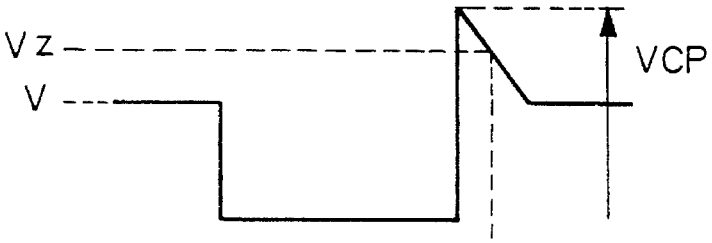
Figure 5D:
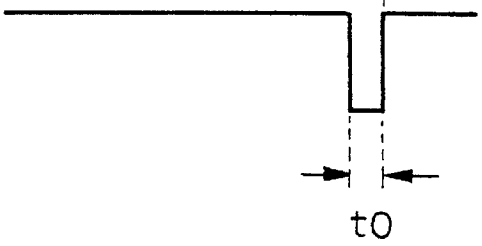

FIGS. 5A through 5D are signal waveforms of the circuit of FIG. 4 when an inductance state of the printing coil 60 is detected. FIG. 5A illustrates a control signal S of the drive transistor 68, FIG. 5B illustrates a current IL flowing through the printing coil 60, FIG. 5C illustrates a voltage VC of the node C, and FIG. 5D illustrates the output signal Cout3.

When the drive transistor 68 turns ON during a predetermined period t as shown in FIG. 5A, the current IL shown in FIG. 5B flows through the printing coil 60. An intensity of the current IL is determined by the following formula (1);

$$IL=(V/L)t \quad (1)$$

wherein,

V designates a voltage of the voltage source; and

L designates an inductance of the printing coil 60.

When the driving transistor 68 turns OFF after the period t, the voltage VC of the node C changes as shown in FIG. 5C by a back electromotive force. Namely, the voltage VC has a peak voltage VCP. The peak voltage VCP is represented by the following formula (2);

$$VCP=R(V/L)t \quad (2)$$

wherein, R designates a resistance value of the resistor 130.

This high voltage generation by the back electromotive force is detected by the back electromotive force detection circuit 120. When a threshold VZ of the zener diode 134 is at a level shown in FIG. 5C, the transistor 136 turns ON during a period t0 in which the voltage VC is over the threshold level VZ of the zener diode 134, and the back electromotive force detection circuit 120 outputs a signal Cout as shown in FIG. 5D.

It is apparent that the high voltage generated by the back electromotive force is determined by a value of the inductance of the coil 60. Therefore, by comparing this period t0 of the output signal Cout with a reference period obtained when the inductance of the coil 60 is appropriate, it can be judged whether or not the inductance of the printing coil is normal.

Of course, when the printing coil has a defect of a complete open or short circuit, the inductance value of the printing coil 60 is out of the normal range. Therefore, the back electromotive force detection circuit 120 can also detect such defects.

As described above, in the first embodiment, the back electromotive force is generated by switching the drive transistor 68. The drive transistor 68 and the printing control portion 48 are already provided in a prior art impact printer, therefore, by adding the back electromotive force detection circuit 120, the detection of the inductance state of the coil 60 can be performed.

In the back electromotive force detection circuit 120 of FIG. 4, the judgement of the inductance of the printing coil 60 is performed by detecting the length of the period in which the voltage VC of the node C is over a predetermined level corresponding to the threshold level of the zener diode 134, however, there can be many modifications of this detection circuit 120. For example, the detection of the inductance state of the printing coil 60 can be performed by detecting whether a peak voltage of the node C is within a predetermined range by arranging two pairs of detection circuits including two zener diodes having different threshold levels. Further, the zener diode 134 can be replaced with a well-known comparator circuit.

As described above, a prior art impact printer usually includes a detection function for detecting complete open or short circuits in printing coils and drive transistors. The second embodiment is an example in which the detection circuit shown in FIG. 4 is added to a prior art impact printer including a detection function for detecting complete open or short circuits in the printing coils and drive transistors.

Figure 6:
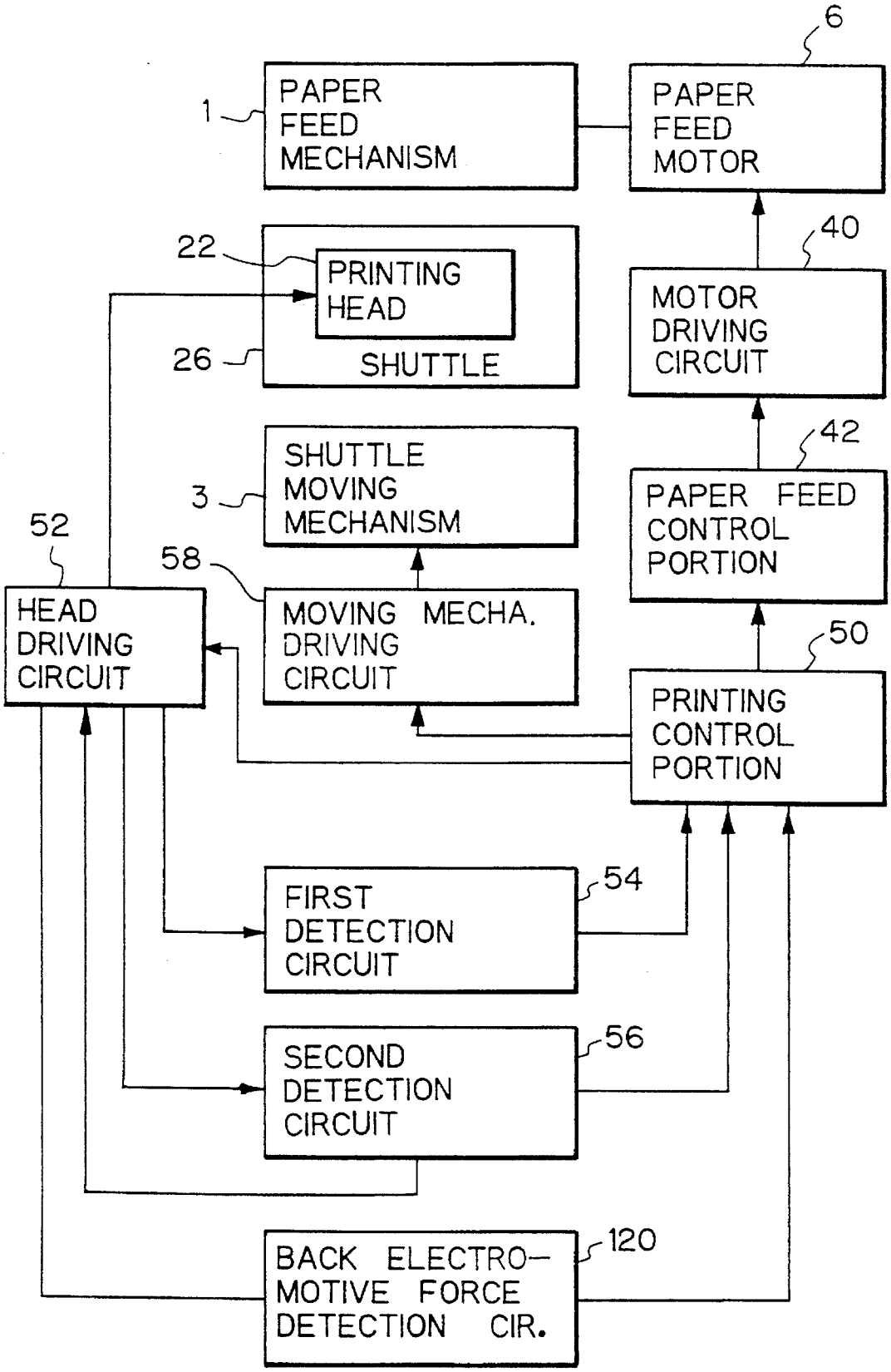
FIG. 6 is a schematic block diagram of a driving portion, a control portion and a detection portion of a second embodiment.

FIG. 6 is a block diagram of a driving portion, a control portion and a detection portion of an imapct printer of a second embodiment.

As shown in FIG. 6, the impact printer of the second embodiment includes a paper feed mechanism 1, a paper feed motor 6, a motor driving circuit 40, a paper feed control portion 42, a shuttle 26 including a printing head 26, a shuttle moving mechanism 3, a moving mechanism driving circuit 58, a printing control portion 50, a head driving circuit 52, a first detection circuit 54, a second detection circuit 56 and a back electromotive force detection circuit 120. The paper feed mechanism 1, the printing head 22, the shuttle 26 and the shuttle moving mechanism 3 have constitutions described with reference to FIGS. 1, 2 and 3. The printing control portion 50 controls a paper feed operation, a shuttle feed operation, a printing operation of the printing head, a communication operation with a host computer and so forth. The printing control portion further detects a state of each portion of the impact printer and controls each portion according to the detected results. In the figure, only detection circuits relating to the printing head driving circuit 52 are shown.

The first and second detection circuits 54, 56 are provided in order to detect complete open and short circuits in the printing coils and the drive transistors. The back electromotive force detection circuit 120 is provided in order to detect whether or not inductances of the printing coils are normal.

Figure 7:
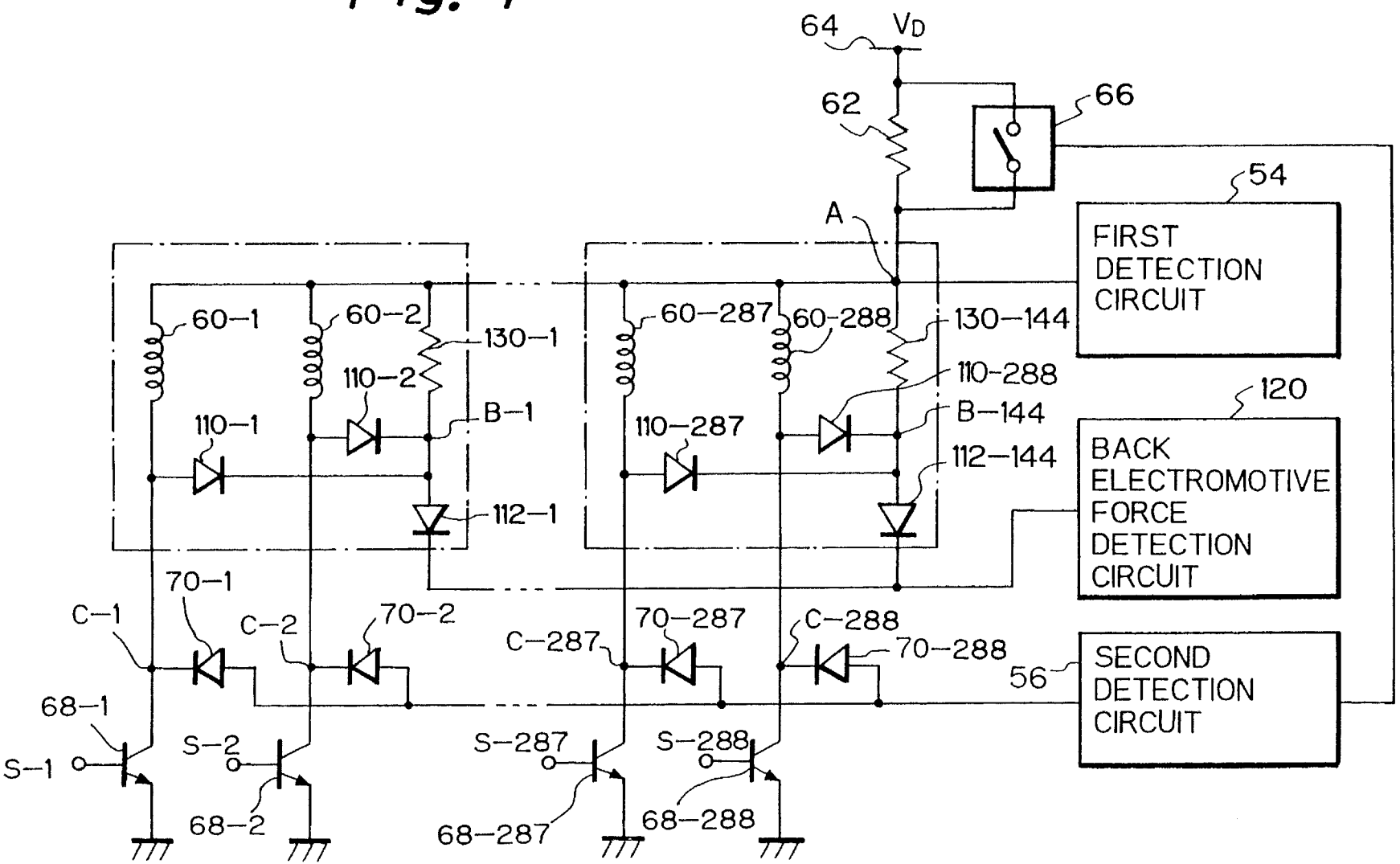
FIG. 7 is a circuit diagram of a detection circuit portion of the second embodiment.

FIG. 7 is a circuit diagram showing a detailed constitution of the printing head driving circuit 52 of the second embodiment. The impact printer of the second embodiment includes a printing head having 288 wire-dot pins, and states of the printing coils and the driving transistors are commonly detected by the first detection circuit 54, the second detection circuit 56 and the back electromotive force detection circuit 120.

As shown in FIG. 7, 288 printing coils 60-1 through 60-288 are respectively arranged in correspondence with the printing wire-dot pins, and one side of each printing coil is connected to a voltage source 64 via a commonly connected resistor 62. Drive transistors 68-1 through 68-288 are respectively arranged at the printing coils, and the other side of each printing coil is connected to ground via the respective drive transistor. Connection nodes C-1 through C-288 of the printing coils and the driving transistors are called third nodes. Control signals S-1 through S-288 output from the printing control portion 50 are input to base terminals of the driving transistors 68-1 through 68-288. States of the driving transistors are independently controlled between ON and OFF by selectively applying the control signals each having a pulse width of 50 μs through 150 μs from the printing control portion 50. Each driving transistor turns ON when a high voltage is applied to its base terminal.

A relay 66 is connected in parallel with resistor 62 for by-passing resistor 62. This relay can be controlled by a signal from the printing control portion 50, and further, as describd later, an output signal of the second detection circuit 56 can turn this relay OFF. The first detection circuit 54 is connected to a first node A to which the printing coils 60-1 through 60-288 are commonly connected.

The second detection circuit 56 is commonly connected to the third nodes C-1 through C-288 via respectively arranged diodes 70-1 through 70-288. Each of these diodes 70-1 through 70-288 isolates a state of the corresponding node from other third nodes.

144 resistors 130-1 through 130-144 are respectively provided for each two printing coils. One end of each resistor is connected to a common line including the first node A, and the other end is connected to the two third nodes via respectively arranged diodes. For example, one end of the resistor 130-1 is connected to the nodes C-1 and C-2 via the diodes 110-1 and 110-2. Nodes of the resistors 130-1 through 130-144 and the diodes 110-1 through 110-288 are called second nodes. The resistors 130-1 through 130-144 correspond to the resistor 130 of FIG. 4, and the diodes 110-1 through 110-288 correspond to the diode of FIG. 4. Therefore, each resistor is commonly used to form two closed loops. However, when the inductance state of each coil is detected, only one transistor is turned OFF and ON and only one closed loop is available, therefore, no problem occurs. The back electromotive force detection circuit 120 is commonly connected to the second nodes B-1 through B-144 via respectively arranged diodes 112-1 through 112-144. Each of these diodes 112-1 through 112-144 isolate a state of the corresponding node from other second nodes.

The back electromotive force detection circuit 120 has the same constitution as that shown in FIG. 4.

Figure 8:
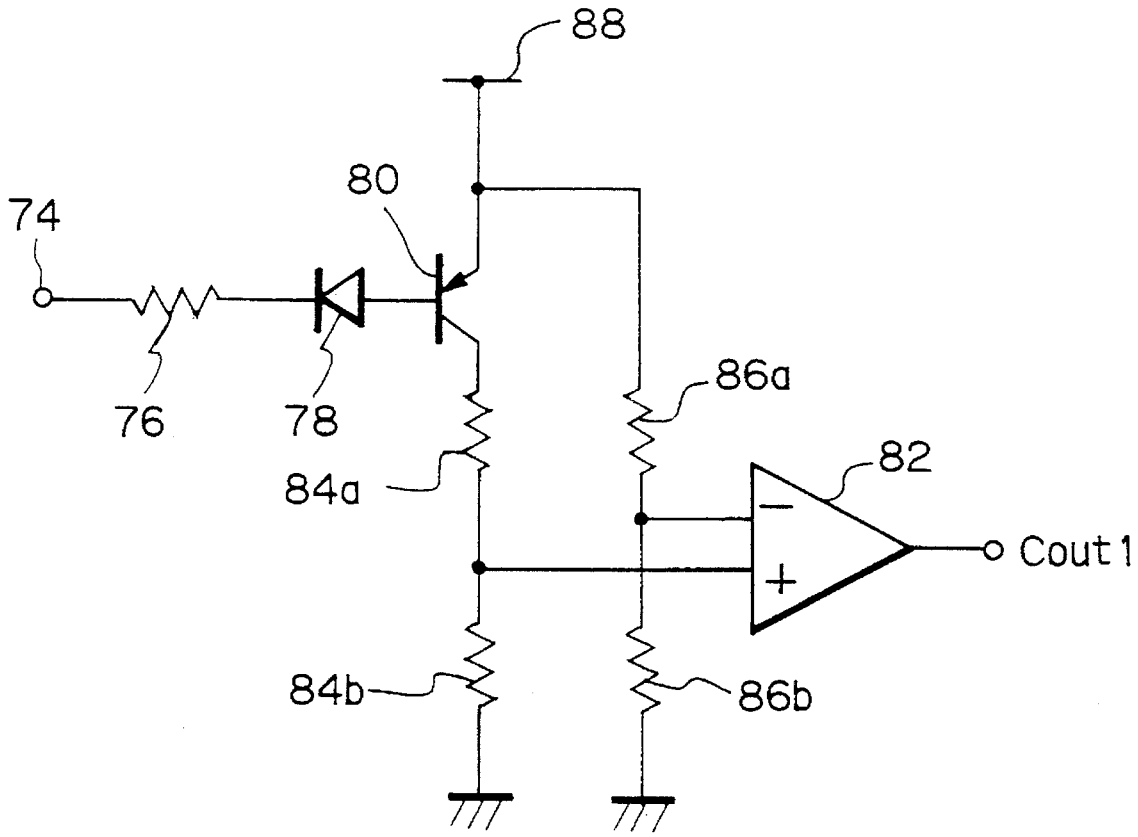
FIG. 8 is a circuit diagram showing a first detection circuit of the second embodiment.

The first detection circuit 54 has a constitution as shown in FIG. 8. An input terminal 74 is connected to the first node A of FIG. 7. A voltage fluctuation of the first node A is input to a base terminal of the transistor 80 via the resistor 76 and the diode 78. A voltage divider composed of resistors **84*a* and 84*b* outputs a first divided voltage by dividing an output of the transistor 80, and a voltage divider composed of resistors 86*a* and 86*b* outputs a second divided voltage by dividing an output of the voltage source 88. A comparator 82 compares the first divided voltage and the second divided voltage, and outputs a comparison output signal Cout1. This comparison output signal Cout1 is input to the printing control portion 50. The comparison output signal Cout1 is a logic value 0 when the potential of the first node A is almost equal to that of the voltage source 64**.

Figure 9:
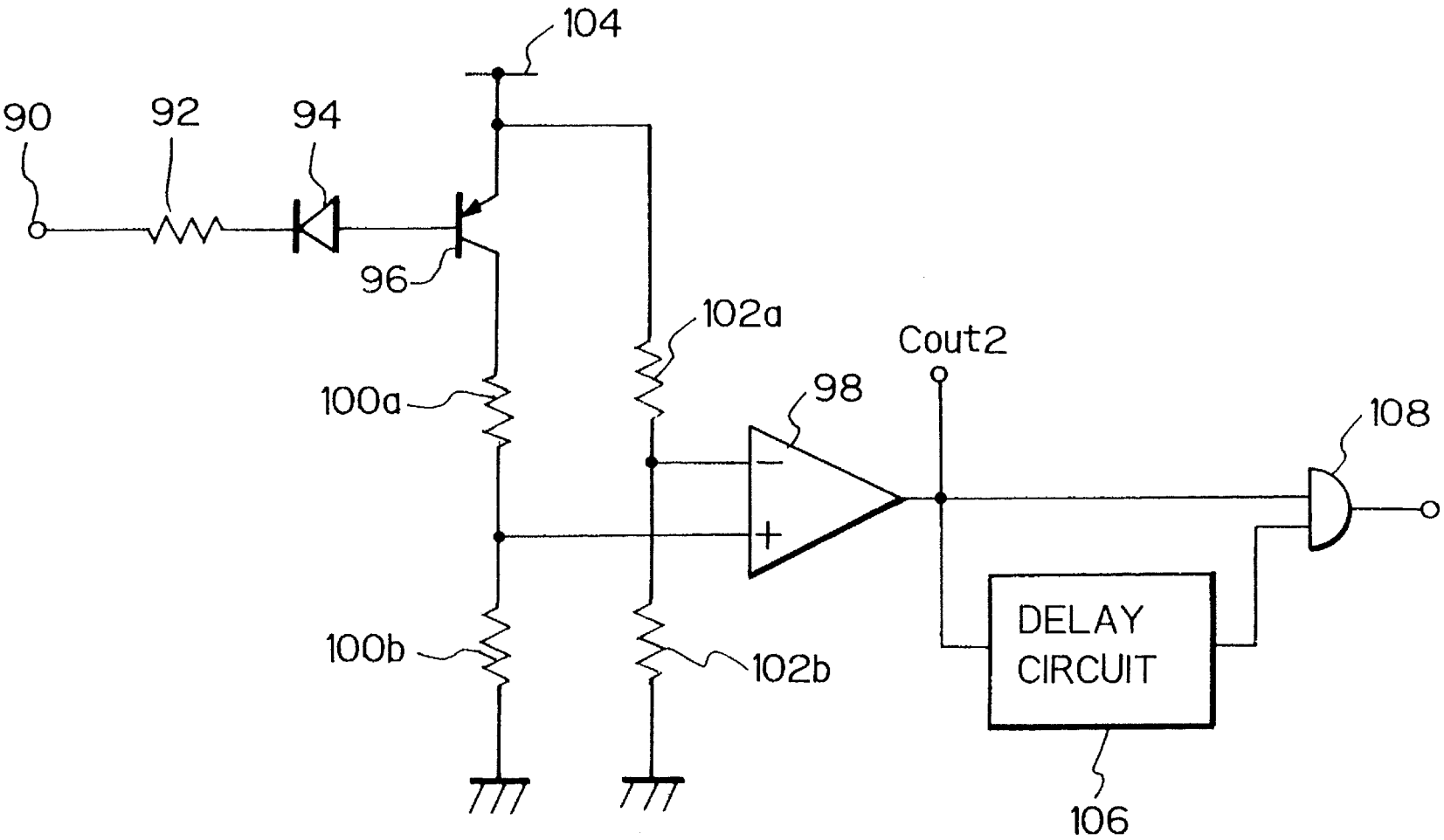
FIG. 9 is a circuit diagram showing a second detection circuit of the second embodiment.

The second detection circuit 56 has a constitution as shown in FIG. 9. An input terminal 90 is connected to the third nodes C-1 through C-288 via the diodes 701 through 70-288 of FIG. 7. A voltage fluctuation of each third node is input to a base terminal of the transistor 96 via the resistor 92 and the diode 94. A voltage divider composed of resistors 100*a* and 100*b* outputs a third divided voltage by dividing an output of the transistor 96, and a voltage divider composed of resistors 102*a* and 102*b* outputs a fourth divided voltage by dividing an output of the voltage source 104. A comparator 98 compares the third divided voltage and the fourth divided voltage, and outputs a comparison output signal Cout2. This comparison output signal Cout2 is input to the printing control portion 50. The comparison output signal Cout2 is a logic value 0 when the potential of each second node is almost equal to that of the voltage source 64.

The comparison output signal Cout2 is further input to a delay circuit 106 which delays an input signal by 300 μs and an AND gate 108 to which an output from the delay circuit 106 is also input. An output from the AND gate 108 is connected to the relay circuit 66. In this way, the AND gate 108 outputs a signal which turns the relay 66 OFF when the comparing output Cout2 continues in a high state for a pre-determined period.

As described above, when every wire-dot pin is driven, the printing control portion 50 outputs a signal to turn each of the driving transistors 68-1 through 68-288 ON for 150 μs. Because the delay time of the delay circuit 106 is 300 μs, the AND gate 108 does not output a positive signal when every drive transistor normally operates.

However, when the comparison output Cout2 continues in a high state for a time longer than the delay time 300 μs of the delay circuit 106 due to a short circuit defect of each drive transistor, the voltage supply to each drive transistor is stopped because the relay 66 is turned OFF by the output signal from the AND gate 108. Accordingly, an occurrance of a fire generated by a continuous current flow due to the short circuit in the drive transistor can be prevented.

Operation of the printing control portion 50 to detect defects in the printing coils 60-1 through 60-288 and the drive transistors 68-1 through 68-288 in the impact printer of the second embodiment is described in the following. When the impact printer is powered ON, any complete open and complete short circuits in the printing coils 60-1 through 60-288 and the drive transistors 68-1 through 68-288 are first detected by using the first and second detection circuits 54 and 56.

After this first operation, operations to detect whether or not the inductances of the coils are appropriate are carried out at any time. There are idle times in which the printing coils stop their operations between printing operations. For example, the printing coils do not operate during paper feed operations. The inductance detecting operations can be carried out during these idle times. It is preferable that the operations of driving the wire-dot pins for detecting the inductance states of the printing coils are carried out without carrying out any actual printing operation. In order to realize these operations, the drive transistors turn ON in durations shorter than those of the normal printing operations. In this way, no printings is actually carried out in the inductance detecting operations.

Figure 10:
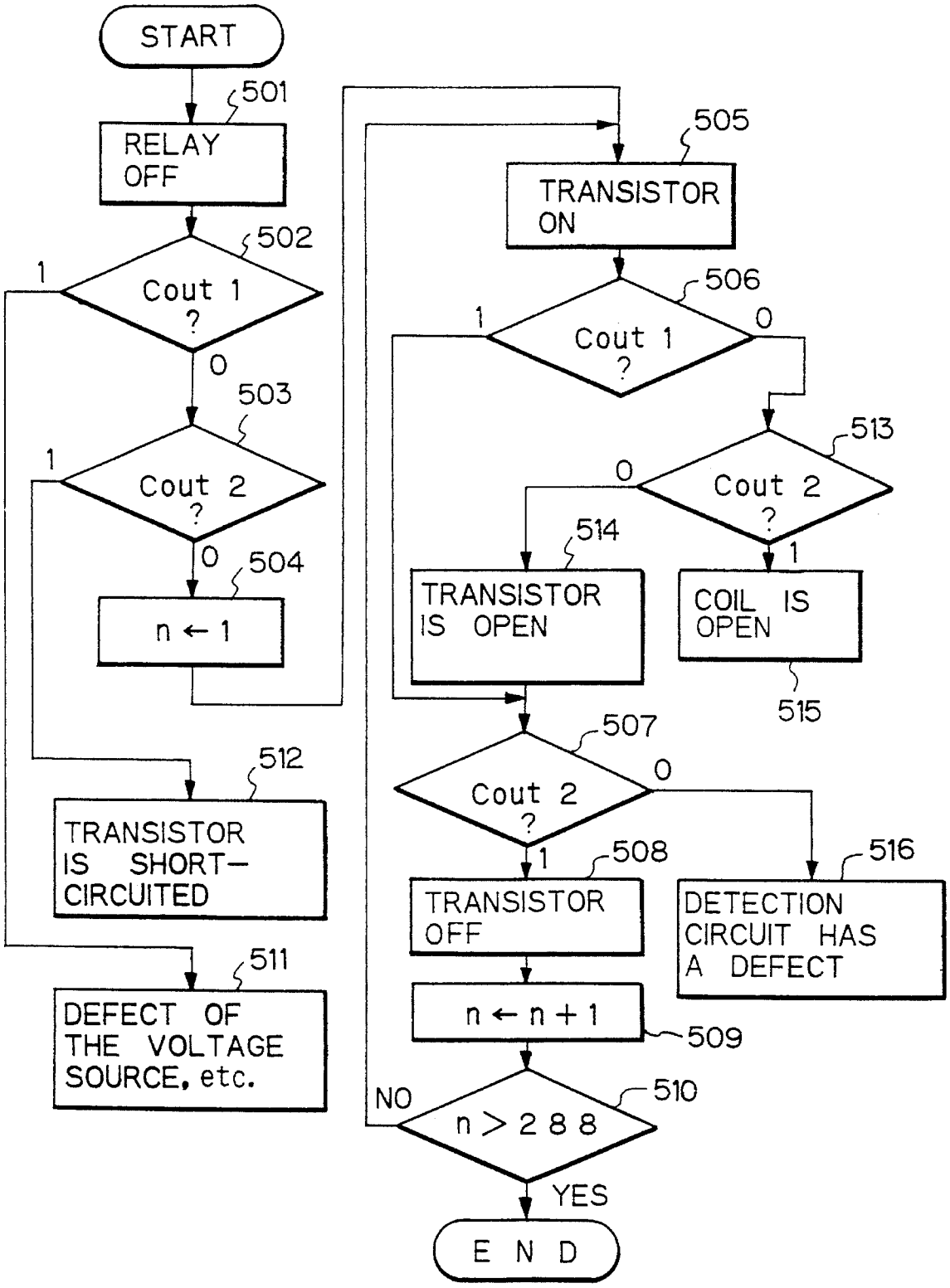
FIG. 10 is a flowchart showing operation of the second embodiment to detect whether or not the printing coils and the transistors are open or short-circuited.

FIG. 10 is a flowchart of the operation to detect complete open and short circuits in the printing coils and the drive transistors.

As shown in FIG. 10, at step 501, the printing control portion 50 outputs a signal to turn the relay 66 OFF. At step 502, the output signal Cout1 of the first detection circuit 54 is checked to whether it is "0" or "1". In a normal state, Cout1 should be "0", namely, a potential of the node A is at high level because no current flows through the resistor 62. Therefore, when Cout1 is "1", it is judged that a defect in the voltage source 64 such as an erroneous connection of a voltage source terminal exists, and the control advances to step 511 and the existence of a defect is displayed on an operation panel (not shown). When Cout1 is "0", the control advances to step 503.

At step 503, the output signal Cout2 of the second detection circuit 56 is checked to determine whether it is "0" or "1". When the output signal Cout2 is "1", it os judged that at least one of 288 drive transistors of the printing control portion 50 is short-circuited, and the control advances to step 512. At step 512, the existence of a defect on a printed circuit board on which the drive transistors are arranged is displayed on an operation panel (not shown), and an indication to replace the printed circuit board is also displayed.

When the output signal Cout2 is "0", the control advances to step 504. At step 504, the printing control portion 50 sets "1" into an internal register n, and the control forwards to step 505.

At step 505, the printing control portion 50 outputs a driving signal S-n to only the n-th driving transistor 68-n according to a value stored in the internal register n. For example, when the value of the internal register n is "1", the drive signal is applied only to the first drive transistor 68-1. The control then advances to step 506.

At step 506, the printing control portion 50 detects whether the output signal Cout1 of the first detection circuit 54 is "0" or "1". The control advances to step 507 when Cout1 is "1", and the control advances to step 513 when Cout1 is "0".

At step 507, the printing control portion 50 checks whether the output signal Cout2 of the first detection circuit 54 is "0" or "1". When Cout2 is "0", the control advances to step 516 and an indication that the back electromotive force detection circuit 120 has a defect is displayed on the operation panel. When Cout2 is "1", the control advances to step 508.

At step 508, the drive signal to drive the n-th drive transistor 68-n is stopped and the n-th drive transistor 68-n turns OFF. Then, the control forwards to step 509. At step 509, the value of the internal register n is incremented by 1, and the control advances to step 510.

At step 513, the printing control portion 50 checks whether the output signal Cout2 of the first detection circuit 54 is "0" or "1". When Cout2 is "0", the printing control portion 50 judges that the n-th drive transistor 68-n is cut off and an indication to replace only a printed circuit board on which the n-th drive transistor 68-n is arranged is displayed on the operation panel. When Cout2 is "0", the printing control portion 50 judges that n-th printing coil 60-n is open, and an indication to replace only a printing block including the n-th printing coil 60-n is displayed.

At step 510, the printing control portion 50 judges whether or not the value of the internal register n is over 288. When it is less than 288, the control returns to step 505, and the next drive transistor and coil are checked. The above operations are repeated until operations relating to all drive transistors are finished.

When the value of the internal register n is over 288, the printing control portion 50 judges that the printing coils and the driving transistors have no defects. The first detection operation is thus finished, and the relay 66 is turned ON.

Figure 11:
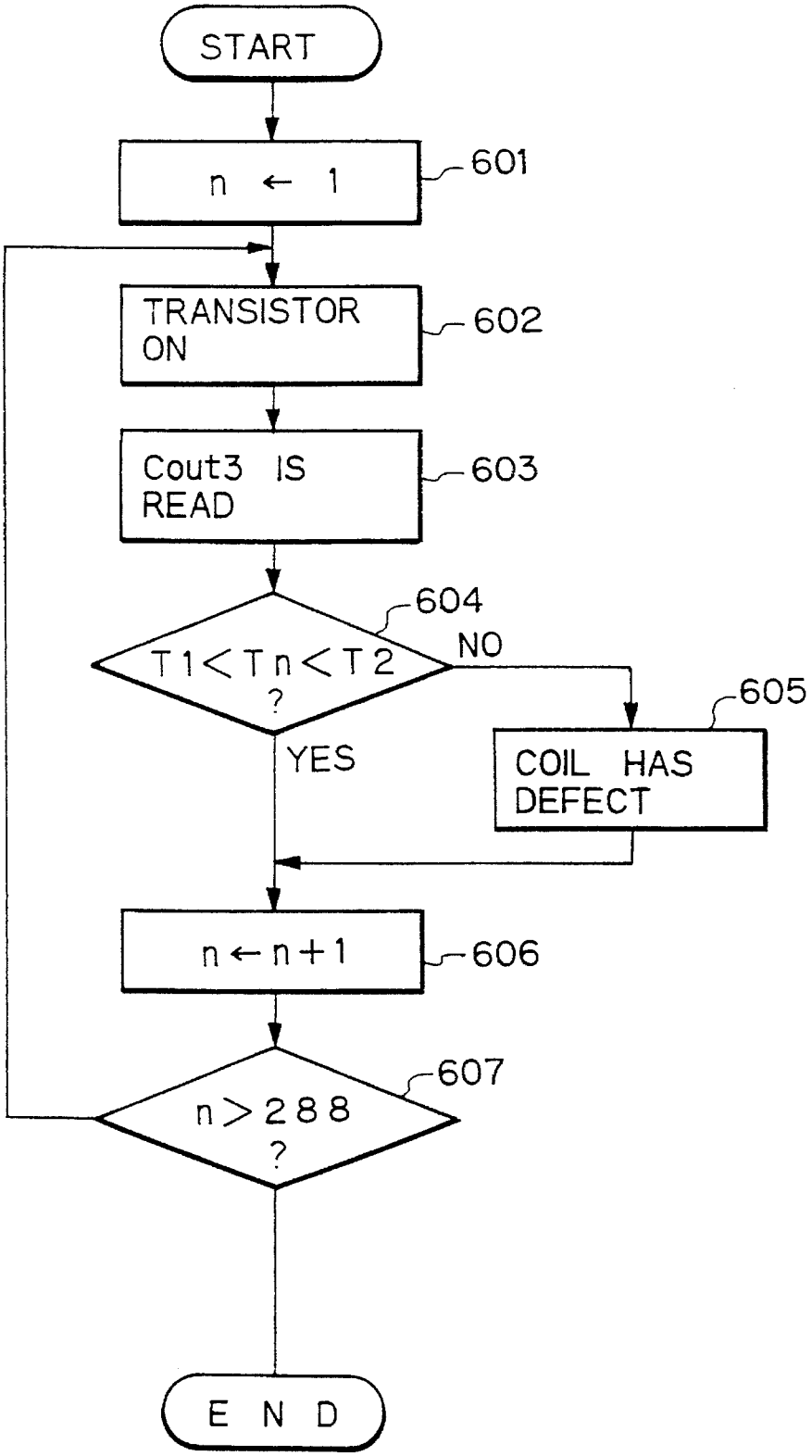
FIG. 11 is a flowchart showing operation of the second embodiment for detecting whether or not every printing coil has an appropriate inductance.

The inductance detection operation is carried out after the first detection operation. FIG. 11 is a flowchart of the inductance check operation.

At step 601, the printing control portion 50 sets "1" into the internal register n, and the control advances to step 602.

At step 602, the printing control portion 50 outputs a drive signal S-n only to the n-th driving transistor 68-n according to a value stored in the internal register n. For example, when a value of the internal register n is "1", the drive signal is applied only to the first drive transistor 68-1. As described above, the drive signal is shorter than that of a normal printing operation so as not to actually carry out a printing operation. The control then advances to step 603.

At step 603, the printing control portion 50 measures a duration time Tn in which the output signal Cout3 of the back electromotive force detection circuit 120 has a high logic value.

At step 604, the printing control portion 50 detects whether or not the detected duration time Tn is within a range between predetermined reference time t1 and t2. When it is out of that range, the printing control portion 50 judges that the inductance of the n-th printing coil 60-n is inappropriate, namely, the n-th printing coil 60-n has a defect due to a partial short circuit or a defect in a magnetic circuit, and then the control advances to step 605. When the detected duration time Tn is within the range of t1 and t2, the printing control portion 50 judges that the n-th coil has an appropriate inductance, and the control advances to step 606.

At step 605, the printing control portion 50 displays an indication that the n-th coil 60-n has an inappropriate inductance. The number of the printing coil having a defect is stored, and then, the control advances to step 606.

At step 606, the printing control portion 50 judges whether or not the value of the internal register n is over 288. When it is less than 288, the control returns to step 602, and an inductance state of the next printing coil is detected. The above operations are repeated until detection is finished for every printing coil.

In the second embodiment, short circuit defects in the drive transistors which can cause a serious damage to an impact printer are preliminarily detected, and then, the inductance detection is carried out to determine whether each coil has an appropriate inductance. Accordingly, the safety of the apparatus is improved in the second embodiment.

Many widely different embodiments of the present invention may be constructed without departing from the spirit and scope of the present invention, and it should be understood that the present invention is not limited to the specific embodiments described in this specification, except as defined in the appended claims.

We claim:

1. An impact printer comprising:

at least one printing coil for driving a printing element;

switching means for controlling said printing element by switching a current flowing through said printing coil;

short circuit detection means for detecting a full short circuit defect of said printing coil; and inductance detection means for detecting whether or not said printing coil has an appropriate inductance value within a predetermined range between open circuit and full short circuit of said coil; and circuit means for actuating said inductance detection means after said short circuit detection means determine that full short circuit defects of said printing coil do not exist.

2. An impact printer as set forth in claim 1, wherein said inductance detection means includes a back electromotive force detection circuit for detecting a back electromotive force generated by switching said switching means.

3. An impact printer as set forth in claim 2, wherein said switching operation of said switching means has an operation time shorter than that of a normal printing operation so as not to actually carry out a printing operation.

4. An impact printer as set forth in claim 2, wherein said impact printer includes a plurality of pairs of said printing coils and said switching means, said back electromotive force detection circuit being commonly used to detect inductance states of said printing coils, an inductance state of every coil being sequentially detected by switching said switching means one-by-one.

5. An impact printer as set forth in claim 3, wherein said impact printer includes a plurality of pairs of said printing coils and said switching means, said back electromotive force detection circuit being commonly used to detect inductance states of said printing coils, an inductance state of every printing coil being sequentially detected by switching said switching means one-by-one.

6. An impact printer as set forth in claim 1, wherein said impact printer further comprises:

coil open circuit detection means for detecting whether or not said printing coil has a defect of an open circuit; and switching open/short detection means for detecting whether or not said switching means has a defect of an open circuit or a full short circuit.

7. An impact printer as set forth in claim 6, wherein, after an operation of said coil detection means and said switching means detection means to confirm that said printing coil and said switching means have no defects of an open circuit or a full short circuit, said inductance detection means operates to determine by comparing of EMF characteristics, whether said printing coil has an appropriate inductance value.

8. An impact printer as set forth in claim 7, wherein, said operation to determine whether said printing coil has an appropriate inductance value is performed while said printing elements are not being used for printing.

* * * * *